US005679212A

United States Patent [19]

Kato et al.

[11] Patent Number: 5,679,212

[45] Date of Patent: Oct. 21, 1997

[54] METHOD FOR PRODUCTION OF SILICON WAFER AND APPARATUS THEREFOR

[75] Inventors: Tadahiro Kato; Hideo Kudo, both of Fukushima-ken, Japan

[73] Assignee: Shin-Etsu Handotai Co., Ltd., Tokyo, Japan

[21] Appl. No.: 534,926

[22] Filed: Sep. 28, 1995

Related U.S. Application Data

[63] Continuation of Ser. No. 250,620, May 27, 1994, abandoned.

[30] Foreign Application Priority Data

May 27, 1993 [JP] Japan ..... 5-148629

[51] Int. Cl.[6] ..... B24B 37/00

[52] U.S. Cl. ..... 156/636.1; 156/345; 156/645.1

[58] Field of Search ..... 156/636.1, 645.1, 156/345; 451/41, 264, 269, 287; 216/88, 89

[56] References Cited

U.S. PATENT DOCUMENTS

| | | | |
|---|---|---|---|
| 4,276,114 | 6/1981 | Takano et al. | 156/645 |
| 4,607,496 | 8/1986 | Nagaura | 51/131.4 X |
| 4,968,381 | 11/1990 | Prigge et al. | 156/636.1 |
| 5,113,622 | 5/1992 | Nishiguchi et al. | 51/131.4 X |
| 5,376,222 | 12/1994 | Miyajima et al. | 216/88 |

FOREIGN PATENT DOCUMENTS

| | | | |
|---|---|---|---|
| 56868 | 4/1985 | Japan | 51/131.4 |
| 39173 | 2/1987 | Japan | 51/131.4 |
| 4-343427 | 11/1992 | Japan . | |

*Primary Examiner*—Thi Dang

*Attorney, Agent, or Firm*—Ronald R. Snider

[57] ABSTRACT

The work of grinding of a silicon wafer is carried out in an etchant containing no loose abrasive and permitting selective etching of deformed layers existent in the surface part of said wafer. The removal of the deformed layers and the heavy metals from the wafer is effected simultaneously and quickly owing to the execution of the work of grinding in the etchant and the consequent synergism of the work of grinding and etching.

5 Claims, 5 Drawing Sheets

METHOD FOR PRODUCTION OF SILICON WAFER AND APPARATUS THEREFOR

This application is a continuation of application Ser. No. 08/250,620, filed May 27, 1994, now abandoned.

BACKGROUND OF THE INVENTION

1. Field of the Invention

This invention relates to a method for the production of silicon wafers for use in semiconductor devices and an apparatus therefor. More particularly, this invention relates to a method for grinding wafers sliced from single crystal silicon ingots (hereinafter the wafer in manufacturing process referred to simply as "wafer") in an etchant and an apparatus therefor.

2. Description of the Prior Art

The silicon wafer to be used for the manufacture of semiconductor devices are generally produced by procedures which comprise the steps of cylindrical grinding of a single crystal silicon ingot (preparation of a block), orientation flat machining, slicing, chamfering, lapping, etching, and mirror polishing to be sequentially performed in the order mentioned.

The etching step mentioned above is intended to remove from the surface of a wafer the deformed layer and contaminated heavy metals which have been due to the mechanical processes extending from cylindrical grinding through lapping.

In the conventional steps of chamfering and lapping of wafers, the grain size of such bonded abrasives and loose abrasives used for abrasive materials and other similar process conditions have been controlled for the purpose of enhancing the efficiency of process and decreasing the depth of the deformed layer due to machining process to the fullest possible extent. The production of silicon wafers which have no deformed layer is difficult to attain. Further, such heavy metals as originate in the abrasive materials and so on persist on the machined surface layer of the wafer. The etching step mentioned above is intended to remove the deformed layers and the heavy metals and thereby to prevent them from inducing micro defects near the surface of a silicon wafer or such crystal defects as stacking faults.

The conventional process for the production of silicon wafers, however, is at a disadvantage in not only comprising many process steps but also failing to accomplish perfect removal of the deformed layer and the heavy metals because of the operations of machining and etching are carried out by two separate steps.

In the case of a wafer which contains deformed layers of relatively large depth or heavy metals in a large amount, it is necessary that the etching depth should be increased according to the degree of contamination. This increased etching depth results in the changing the shape of the wafers and consequently renders difficult the formation of a silicon wafer in a desired shape.

SUMMARY OF THE INVENTION

The present invention, produced in the light of the true state of prior art described above, has for an object thereof the provision of a method for the production of silicon wafers which accomplishes simplification of the process for production of the silicon wafers, reduction of the time required for the production, and exaltation of the quality of the produced silicon wafer by causing the operation of grinding and the operation of etching of the wafer to proceed simultaneously (parallelly) in an etchant and an apparatus for working the method which enjoys simplicity of construction.

The first aspect of this invention resides in a method for producing silicon wafers for use in semiconductor devices by cylindrical grinding a single crystal silicon ingot kept in rotation on a pulling axis, slicing the cylindrically ground silicon ingot in a direction perpendicular or substantially perpendicular to the pulling axis thereby obtaining a wafer, chamfering the wafer, then grinding the main surface of the wafer in an etchant, and polishing the ground surface of the wafer for mirror finish, which method is characterized by the fact that the etchant in which the grinding is carried out contains no loose abrasive and permits selective etching of a deformed layer existent in the surface part of the wafer.

The second aspect of this invention resides in a method set forth in the first aspect of this invention, wherein the etchant is a ternary reagent consisting of 5 to 35 wt % of hydrofluoric acid, 15 to 45 wt % of nitric acid, and 40 to 80 wt % of water or a binary reagent consisting of 30 to 50 wt % of sodium hydroxide or potassium hydroxide and 70 to 50 wt % of water.

The third aspect of this invention resides in an apparatus for producing silicon wafers for use in semiconductor devices by slicing a wafer from a single crystal silicon ingot and grinding the main surface of the silicon wafer in the presence of an etchant containing no loose abrasive, which apparatus is characterized by comprising an etching tank adapted to store an etchant, a retaining member adapted to fix a wafer, a grinding member furnished with a grindstone, the two members disposed opposite each other in the vertical direction inside the etching tank, and a vertical motion mechanism capable of moving the retaining member and the grinding member toward each other until close mutual contact and away from each other, the wafer fixed by the retaining member and the grinding member both being rendered rotatable in mutually opposite directions or, either the wafer or the grinding member being rendered rotatable, and either the retaining member or the grinding member being rendered revolvable relative to the retaining member where both of the two members are rotatable or, where either of the two members is rotatable, the rotatable member being rendered revolvable relative to the retaining member.

The fourth aspect of this invention resides in an apparatus for producing silicon wafers for use in semiconductor devices by slicing wafers from a single crystal silicon ingot and grinding the main surface of the silicon wafer in the presence of an etchant containing no loose abrasive, which apparatus is characterized by comprising an etching tank filled with an etchant, a retaining member adapted to fix a wafer, a grinding member furnished with a grindstone, the surface to fix a wafer on the retaining member and the grindstone set in place on the grinding member being disposed opposite each other in the vertical direction, the retaining member being so disposed as to induce a rotation and a vertical reciprocating motion, and the grinding member being so disposed as to induce a reciprocating motion within the etching tank.

The fifth aspect of this invention resides in an apparatus for producing silicon wafers for use in semiconductor devices by slicing wafers from a single crystal silicon ingot and grinding the main surface of the silicon wafer in the presence of an etchant containing no loose abrasive particle, which apparatus is characterized by comprising an etching tank provided on the bottom surface thereof with a grindstone for grinding a wafer, rendered rotatable, and filled with an etchant, and a retaining member adapted to fix a wafer, the surface to fix a wafer on the retaining member being opposed to the grindstone in the vertical direction and, at the same time, adapted to produce a vertical reciprocating motion relative to the etching tank, and the retaining member being so disposed as to induce a rotation alone or in conjunction with a revolution.

The sixth aspect of this invention resides in an apparatus for producing silicon wafers for use in semiconductor devices by slicing wafers from a single crystal silicon ingot and grinding the main surface of the silicon wafer in the presence of an etchant containing no loose abrasive, which apparatus is characterized by comprising a retaining member adapted to fix a wafer and a grinding member furnished with a grindstone, the two members disposed opposite each other in the vertical direction, and an etchant supply pipe capable of supplying an etchant to a grinding part composed of the retaining member and the grinding member, the retaining member and the grinding member being jointly adapted to be moved toward each other until close mutual contact and away from each other, the wafer fixed by the retaining member and the grinding member both being rendered rotatable in mutually opposite directions or, either the wafer or the grinding member being rendered rotatable, and either the retaining member or the grinding member being rendered revolvable relative to the retaining member where both of the two members are rotatable or, where either of the two members is rotatable, the rotatable member being rendered revolvable relative to the retaining member.

The seventh aspect of this invention resides in an apparatus according to any of the third, the fourth, and fifth aspect, wherein the etching tank is provided with an etchant supply pipe, an overflow discharge pipe, and a drainpipe.

BRIEF DESCRIPTION OF THE DRAWINGS

The invention will be better understood and the objects and features thereof other than those set forth above will become apparent when consideration is given to the following detailed description thereof, which makes reference to the following drawings, wherein.

DETAILED DESCRIPTION OF THE PREFERRED EMBODIMENTS

Figure 1:
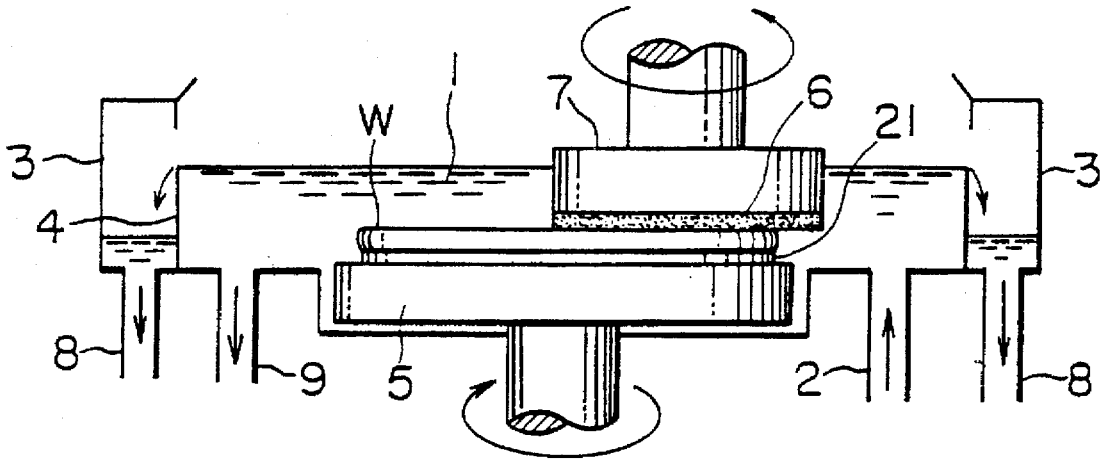
FIG. 1 is a schematic cross-sectioned front view illustrating an example of the grinding apparatus according to the present invention.

Now, the method for the production of silicon wafers and the apparatus for working the method according to the present invention will be described in detail below.

The mirror polished silicon wafer which is used for the production of semiconductor devices is generally manufactured by a procedure which comprises the steps of cylindrical grinding a single crystal silicon ingot, orientation flat machining, slicing, chamfering lapping, etching, and mirror polishing to be sequentially performed in the order mentioned. In this case, the operation of lapping follows that of chamfering at times or the operation of chamfering follows that of lapping at other times. In the machining operations which are involved in the production of a silicon wafer, the surface part of the wafer is defiled with deformed layers and heavy metals which arise from the machining operations.

In contrast, the method set forth in the first aspect of this invention allows omission of the conventional etching step because it effects the operation of slicing wafers from a single crystal silicon ingot, the operation of chamfering the wafer, and the operation of grinding the main surface of the wafer in an etchant before the operation of mirror polishing the ground wafer. Further, the work of grinding which is performed in the etchant according to the present invention does not need to be limited to the treatment of the main surface of the wafer but may be effectively applied to the operation of chamfering. This method, therefore, permits highly efficient production of silicon wafers whose surface part is defiled very little with deformed layers or heavy metals as compared with the silicon wafer obtained solely by machining as practiced heretofore.

For example, the production of the wafer may be attained by a modified procedure which comprises the steps of cylindrical grinding of a single crystal silicon ingot, orientation flat machining, slicing, chamfering in the etchant peculiar to this invention, grinding in the etchant peculiar to this invention, and mirror polishing to be performed sequentially in the order mentioned.

In the method for production of the silicon wafer according to this invention, a mixed acid or an aqueous alkaline solution may be used as the etchant. The etching function (etching rate) of the etchant is desired to be moderate as compared with that of the etchants heretofore known in the art. The word "moderate" modifying the etching function herein is used on the assumption of the comparison between the etching rate in the etchant used in this invention and that in the conventional etchant used exclusively at the step of etching in this invention. The moderate etching function suffices this invention because the work of grinding and that of etching are simultaneously carried out in this invention and, as a result, the rate of the etching of the deformed layers attained in this invention is rather increased as compared with the rate of the etching in the the conventional etchant exclusively at the step of etching.

Figure 7:
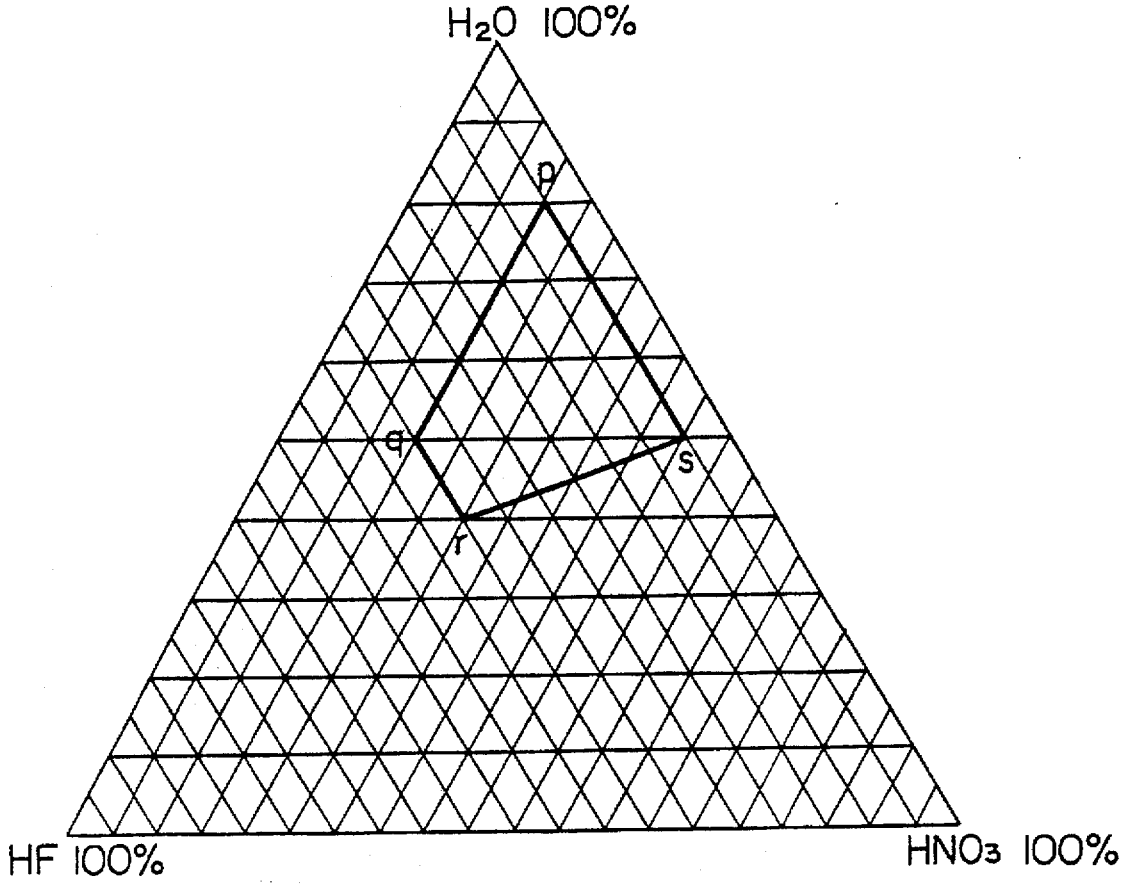
FIG. 7 is a ternary composition diagram showing the range of desirable composition of the etchant to be used for the present invention.

The etchant which is formed of the mixed acid mentioned above is desired to be such as is recited in the second aspect of this invention. This etchant is a ternary reagent which comprises 5 to 35 wt % of hydrofluoric acid (HF), 15 to 45 wt % of nitric acid, and 40 to 80 wt % of water (the total of the three proportions is 100 wt %). To illustrate this composition graphically, all the allowable proportions of the components of this ternary reagent are represented by the points falling on the sides of the tetragonal figure having the vertexes p, q, r, and s in the ternary composition diagram of FIG. 7 and the points falling inside the tetragonal figure. As an alkaline etchant, an aqueous solution containing 30 to 50 wt % of sodium hydroxide or potassium hydroxide as recited in the second aspect of this invention is desirably used.

In the method for production of silicon wafers set forth in the first aspect of this invention, the removal of the deformed layers and the heavy metals from the wafer is effected simultaneously and quickly owing to the execution of the work of grinding in the etchant and the consequent synergism of the works of grinding and etching.

Further in the method for production of silicon wafers set forth in the first aspect of this invention, the process of production can be simplified and the time required for the execution of the process can be curtailed because the works of lapping and etching which have been heretofore performed at two separated steps can be executed at one step herein.

The results of an experiment which has been carried out on the method for production set forth in the first aspect of this invention indicate that this method obviates the necessity for loose abrasives which have been indispensable for the conventional step of lapping and that it imparts to the wafer the flatness equivalent in degree to the flatness obtainable by the conventional surface grinding because the transfer of the surface of the grindstone is attained by properly selecting the components and composition of the etchant and the grain size of the abrasives and, at the same time, increasing the stock for grinding. When the deformed layers formed on the wafer after the step of grinding in the process of production according to the present invention is tested for the length of life time and for the manifestation of OSF (oxidation induced stacking fault), the results of this test indicate that the life time is longer and the number of OSF is less than those found on the wafer which has undergone the operations of lapping and etching according to the conventional method.

In the execution of the method for production set forth in the first aspect of this invention, it is important that good balance should exist between the rate of etching and that of grinding.

The etching operation performed by the etchant which is used simultaneously with the operation of wafer grinding as set forth in the second aspect of this invention is moderate as compared with what is obtained in the conventional exclusive step of etching. By adopting this etchant, the balance between the rate of etching and that of grinding can be easily adjusted. As a result, the method of this invention permits a silicon wafer which is free from deformation and excellent in quality to be produced quickly with a simple process.

In the apparatus for production of a silicon wafer which is set forth in the third aspect of this invention, the retaining member mentioned above is elevated above the liquid level of the etchant and, subsequently to the fixation of a given wafer thereon, lowered below the liquid level to immerse the wafer in the etchant. Then, the grinding member mentioned above is lowered into the etchant and brought into tight contact with the wafer. Subsequently, the retaining member is set into rotation and, at the same time, the grinding member is set into both rotation and revolution. As a result, the work of grinding and that of etching simultaneously proceed on the wafer and the deformed layers and the contaminated heavy metals which have been generated by the grinding and the deformed layers and the contaminated heavy metals which have been generated during the preceding machining step are quickly removed.

In the apparatus for production of silicon wafers which is set forth in the fourth aspect of this invention, the grinding member is kept immersed in the etchant and the retaining member having the wafer fixed thereon is lowered into the etchant and brought into tight contact with the grinding member. Then, the retaining member is rotated and, at the same time, the grinding member is reciprocated. As a result, this apparatus produces the same operation as the apparatus set forth in the third aspect of this invention.

In the apparatus for production of a silicon wafer which is set forth in the fifth aspect of this invention, the retaining member which has the wafer already fixed thereon is lowered into the etchant and brought into tight contact with the grinding member. Then, the grinding member (etching tank) is set into rotation and, at the same time, the retaining member is set into rotation and revolution. As a result, this apparatus produces the same operation as the apparatus set forth in the third aspect of this invention.

In the apparatus for production of a silicon wafer which is set forth in the sixth aspect of this invention, the grinding member is disposed on the upper side and the retaining member having the wafer fixed thereon is disposed on the lower side and they are opposed to each other in the vertical direction. Then, the grinding member is lowered and brought into tight contact with the retaining member and, with the etchant kept sprayed onto the wafer, the retaining member is set into rotation and the grinding member is set into rotation and revolution. As a result, this apparatus produces the same operation as the apparatus set forth in the third aspect of this invention while keeping the surface of the wafer simultaneously treated with the etchant.

In the apparatus for production of a silicon wafer which is set forth in the seventh aspect of this invention, the otherwise inevitable deterioration of the etchant in the etching tank due to the work of grinding can be precluded by supplying the etchant through the supply pipe and, at the same time, discharging the etchant through the overflow pipe so as to keep the etchant in the etching tank replaced with a newly supplied etchant. Besides, the interior of the etching tank can be cleaned easily and conveniently by discharging the etchant via the drainpipe. This apparatus is desired to be endowed with the function of adjusting the concentration of the etchant and controlling the temperature thereof.

Now, this invention will be described more specifically below with reference to the working examples illustrated in the drawings annexed hereto.

EXAMPLE 1

FIG. 1 is a schematic cross-sectioned front view illustrating the essential part of a wafer grinding apparatus. In this apparatus, an etching tank 4 is provided in the bottom part thereof with a supply pipe 2 for an etchant 1 and in the peripheral part thereof with an annular overflow part 3 for the etchant 1. In the central part of the etching tank 4, a wafer chuck 5 serving as a wafer-retaining member is so disposed as to be rotated and vertically reciprocated. In the upper part of the etching tank 4, a grinding member 7 which is provided in the lower end part thereof with a disc-shaped grindstone 6 is disposed so as to be rotated, revolved and vertically reciprocated and is opposed to the wafer chuck 5.

The wafer chuck 5 and the grinding member 7 are adapted so that they may be moved vertically to be immersed in the etchant 1 held in the etching tank 4 and lifted above the liquid level of the etchant. In FIG. 1, 8 stands for a discharge pipe and 9 for a drainpipe both for the etchant.

A vacuum suction type wafer retaining member, for example, may be adopted as the wafer chuck 5.

Now, one example of the process of wafer grinding by the use of this apparatus will be described below. With the etchant I supplied continuously to the etching tank 4 and left overflowing the etching tank 4, a silicon wafer W is fixed through the medium of a chuck coat 21 on the wafer chuck 5 which has been elevated above the liquid level of the etchant. Then, the wafer chuck 5 is lowered and immersed in the etchant 1. Subsequently, the grinding member 7 is lowered and the grindstone 6 is consequently brought into tight contact with the wafer W with stated pressure. Thereafter, the wafer chuck 5 is set into rotation and the grinding member 7 is set into revolution and, at the same time, the wafer chuck 5 is rotated in the reverse direction.

During the step of grinding, the grinding of the surface of the wafer W can be carried out in the presence of the etchant because the surface of the wafer W is immersed in the etchant 1 and the etchant 1 constantly intervenes between the surface of the wafer and the grinding surface of the grindstone 6.

In the apparatus illustrated in FIG. 1, the grinding member 7 is disposed above and opposite the wafer chuck 5. Optionally, the direction of this vertical opposition of the grinding member 7 and the wafer chuck 5 may be reversed and the grinding member 7 may be rendered rotatable and the wafer chuck 5 rendered both rotatable and revolvable. In the construction illustrated in FIG. 1, the wafer chuck 5 may be adapted to produce no rotation and the grinding member 7 alone adapted to produce both rotation and revolution as occasion demands. The various modifications indicated in the third aspect of this invention may be adopted.

It is further allowable to extend the etchant supply mouth of the supply pipe 2 mentioned to the immediate proximity of the wafer chuck 5 and consequently permit supply of the etchant 1 to the immediate neighborhood of the surface of the wafer. In this case, the etching operation which is effected on the surface of the wafer can be improved.

EXAMPLE 2

Figure 2:
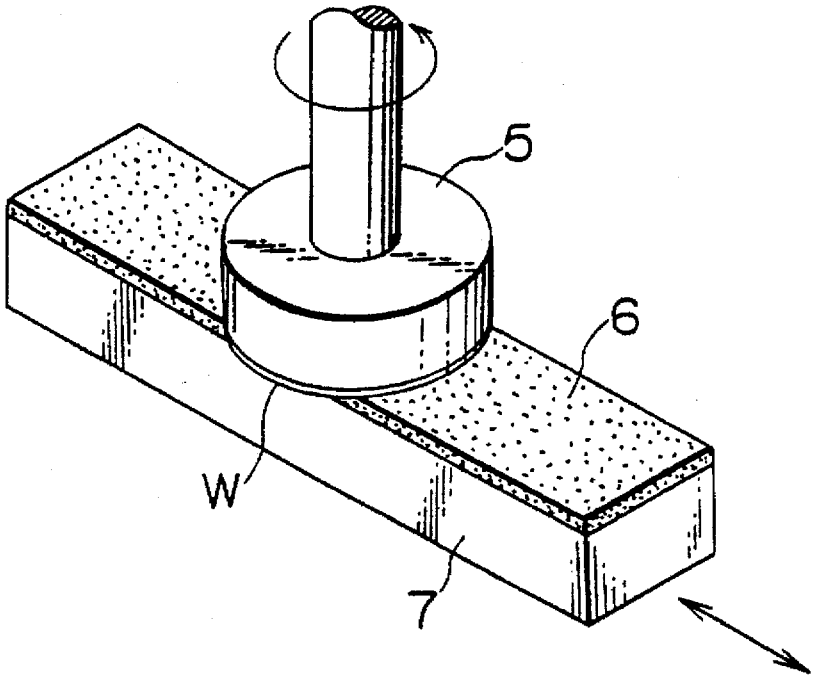
FIG. 2 is a schematic perspective view illustrating the essential part of another example of the grinding apparatus according to the present invention.
Figure 3:
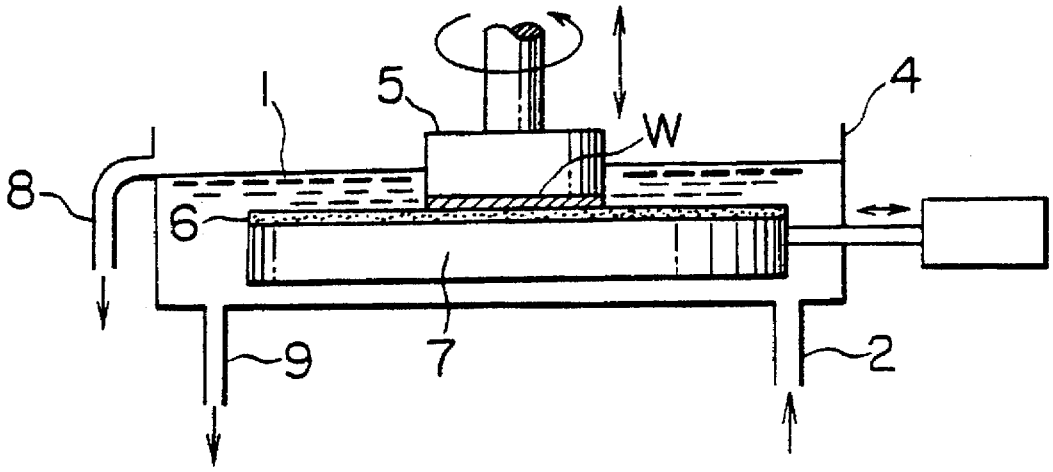
FIG. 3 is a schematic cross-sectioned front view of the apparatus of FIG. 2.

In the grinding apparatus the essential part of which is illustrated in FIG. 2 and FIG. 3, the grinding member 7 which is provided with the grindstone 6 of a rectangular shape is kept immersed in the etchant 1 of the etching tank 4 and adapted to produce a reciprocating motion and, meanwhile, the wafer chuck 5 having the wafer W fixed thereon is disposed so as to induce rotation and a vertical reciprocating motion.

In this grinding apparatus, the wafer is ground by rotating the wafer chuck 5 while keeping the grinding member 7 in the reciprocating motion.

EXAMPLE 3

Figure 4:
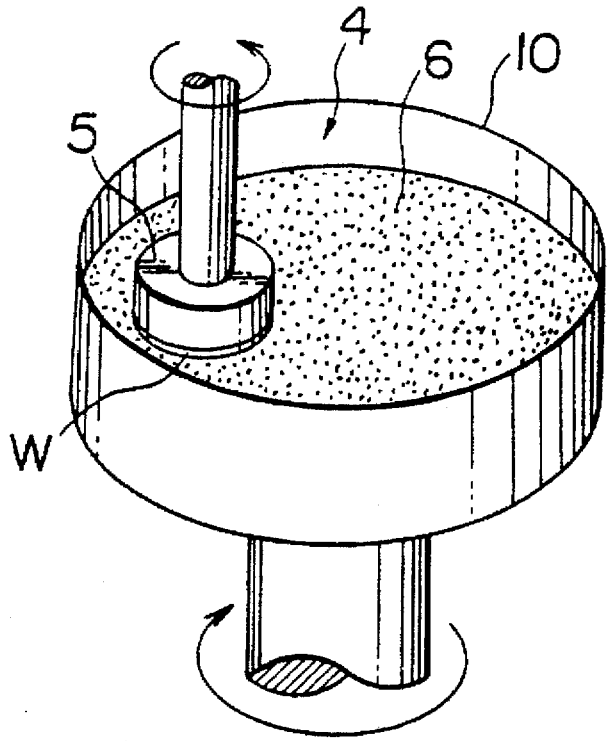
FIG. 4 is a schematic perspective view illustrating the essential part of yet another example of the grinding apparatus according to the present invention.
Figure 5:
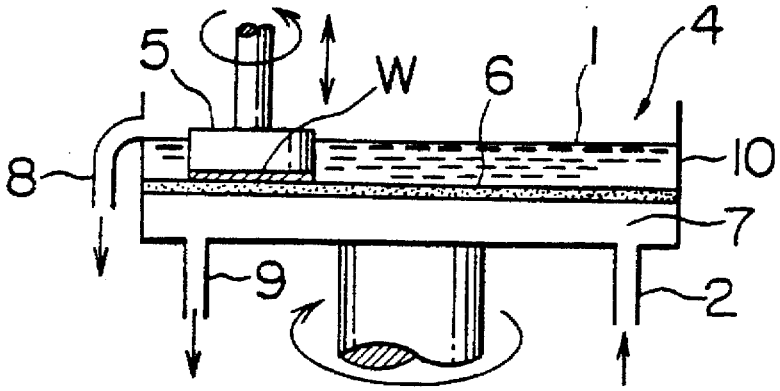
FIG. 5 is a cross-sectioned front view of the apparatus shown in FIG. 4.

In the grinding apparatus the essential part of which is illustrated in FIG. 4 and FIG. 5, the rotatable etching tank 4 is provided on the bottom surface thereof with the grindstone 6 of the shape of a disc. Thus, the etching tank 4 concurrently fulfills the function of the grinding member 7. Thus, the grindstone 6 is immersed in the etchant 1 and the wafer chuck 5 is so disposed as to induce rotation, revolution, and vertical reciprocation. In the diagram, 10 stands for a cylindrical wall.

In the grinding apparatus constructed as described above, the wafer W is ground by rotating the etching tank 4 while keeping the wafer chuck 5 in rotation and revolution.

EXAMPLE 4

Figure 6:
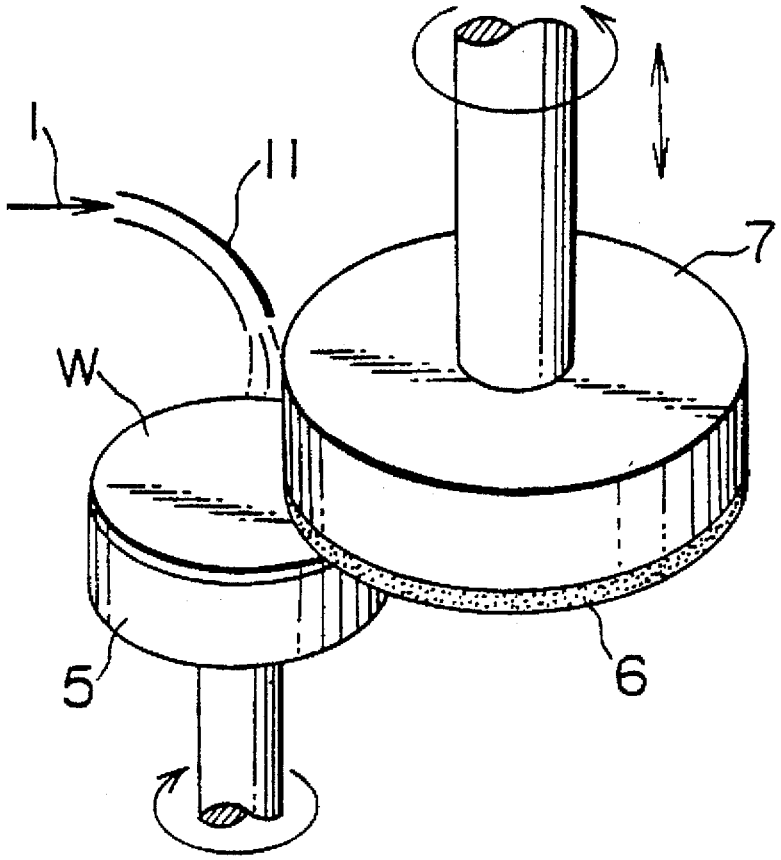
FIG. 6 is a schematic cross-sectioned perspective view illustrating the essential part of still another example of the grinding apparatus according to the present invention.

In the grinding apparatus the essential part of which is illustrated in FIG. 6, the grinding member 7 adapted to rotate, revolve, and vertically reciprocate is disposed in the upper side and the wafer chuck 5 adapted to rotate is disposed in the lower side and they are opposed to each other in the vertical direction. A supply pipe 11 for the etchant 1 is so disposed as to drop or spray the etchant 1 on the surface of the wafer W fixed on the chuck 5. A funnel (not shown) for recovery of the etchant is disposed below the wafer chuck 5.

Since this working example is aimed at effecting the grinding of the surface of the wafer W without using an etching tank, it enjoys simplicity of construction and permits the work of attachment of the wafer W to the wafer chuck 5 and detachment thereof from the wafer chuck 5 to be attained conveniently and easily. This grinding apparatus, therefore, is at an advantage in enabling the wafer surface to be simultaneously sprayed with the etchant 1 and ground and thereafter to be immediately cleaned with purified water.

At least part of the used etchant may be recycled and put to use in the grinding work when desired. In the apparatus constructed as illustrated in FIG. 6, a supply pipe for rinse water may be equipped and a funnel for the recovery of the washings emanating from the cleaning step may be additionally disposed below the wafer chuck 5 (not shown).

Now, concrete examples of the experiment performed on the wafer grinding work according to this invention will be described below.

EXPERIMENT 1:

In this experiment, an apparatus constructed as illustrated in FIG. 1 was used as the grinding apparatus, a mixed acid having a composition of HF: $HNO_3$: $H_2O$=1: 1: 4 (weight ratio ) was used (room temperature) as the etchant, and an abrasive containing alumina ($Al_2O_3$) and Carborundum (SiC) and using a bonding agent of alpha-cyanoacrylate resin was used as the grindstone for the grinding apparatus.

The wafer which had been ground in the etchant was visually examined for surface condition with the aid of a probe type surface roughness tester. The results of this test indicate that the grinding had decreased the surface roughness of the wafer as the starting sample (the wafer given to be ground) and had particularly transformed the part initially protruding from the wafer into a flat shape faithfully conforming to the contour of the grindstone and imply that the wafer would acquire a flat shape in consequence of the transfer of the contour of the grindstone by an increase in the stock for grinding.

Separately, the wafer which had been ground was tested for the degree of persistence of the deformed layers by the wafer life time method and the OSF manifestation method. The results of this test indicate that the life time value was higher and the occurrence of the number of OSF was less when the grade of the grindstone was #1200 and the pressure exerted was 50 gf/cm$^2$ than when the grade was #600 and the pressure was 500 gf/cm$^2$. From the test results, it is clearly noted that the amount of the deformed layers suffered to persist on the ground wafer can be decreased by heightening the grade of the grindstone to be used and decreasing the pressure of the grindstone to be exerted on the wafer. The results of the grinding work vary with the composition of the etchant. The advantage with which the removal of the deformed layers is attained grows according to the rate of etching increases. For the sake of imparting a flat shape to the ground wafer, however, it is necessary that the grade of the grindstone, the pressure to be exerted, and the composition of the etchant should be properly combined.

The rate of machining Vm by the grinding in the etchant is determined by the rate of grinding Vg in purified water and the rate of etching Ve by the use of an acid. It has been experimentally ascertained that these three rates satisfy the expression, $Vm=k\times(Vg+Ve)$, which indicates that the deformed layers arising from grinding is selectively removed by etching and the rate of machining is consequently exalted. In one test run of the grinding with #1200 alumina in an etchant of HF: $HNO_3$:$H_2O$=1: 5.5: 8.4 (weight ratio), k=1.3 was obtained. In another test run of the grinding with #600 Carborundum in the same etchant, k=1.5 was obtained.

EXPERIMENT 2:

When the grinding was performed by following the procedure of Experiment 1 while using an aqueous 45 wt % NaOH solution (room temperature) as the etchant, substantially similar results as in Experiment 1 were obtained.

As respects the surface condition of the ground wafer, the results indicate that the flatness of shape due to the transfer of the contour of the grindstone increased in accordance as the pressure exerted during the work of grinding increased and the prominence of etch pits peculiar to alkaline etching grew in accordance as the pressure decreased.

The trend of the rate of machining observed in the test was similar to that in the preceding test using the mixed acid. The constant k was found to be 1.7 in this case. This fact implies that the aqueous alkaline solution is an etchant having high selectivity.

From the description given thus far, it is evident that the method for production of silicon wafers which is set forth in the first aspect of this invention permits highly efficient production of a silicon wafer of high quality by enabling the removal of the deformed layers and the removal of heavy metals from the produced wafer to be effected simultaneously and quickly owing to the synergism of the work of grinding and the work of etching. This method brings about the effect of enabling the work of grinding and that of etching to be performed by one single process, simplifying the process, and curtailing the time required for the machining.

Further, the method for production of silicon wafers which is set forth in the first aspect of this invention allows the wafer to acquire a surface condition of the same degree as that which is obtained by the surface grinding and enables the ground wafer to enjoy a longer life time and a less OSF counts than the wafer which has undergone the conventional works of lapping and etching by suitably selecting the components and composition of the etchant, the grain size of the grindstone, and other similar factors and, at the same time, increasing the stock for grinding. Thus, this method has the effect of producing a silicon wafer of high quality conveniently, easily, and inexpensively.

The method for production of a silicon wafer which is set forth in the second aspect of this invention has the effect of enabling a silicon wafer free from deformation and excellent in quality to be produced quickly by a simple process.

The apparatus for production of silicon wafers which is set forth in any of the third to fifth aspect of this invention has the effect of not only enabling the work of grinding and that of etching to be carried out at one step by a simple construction and an easy procedure but also simplifying the process and curtailing the time required for the work of machining.

The apparatus for production of silicon wafers which is set forth in the sixth aspect of this invention is so constructed as to effect the grinding of the wafer without requiring the wafer to be immersed in the etchant. It, therefore, enjoys simplicity of construction as compared with the apparatus set forth in any of the third to fifth aspect of this invention, allows the work of fixing the wafer on the retaining member and removing it from the retaining member to be effected easily and conveniently, and brings about the effect of enabling the wafer to be simultaneously cleaned and ground.

In the apparatus for production of silicon wafers which is set forth in the seventh aspect of this invention, since the etchant in the etching tank is kept replaced with a newly supplied etchant by supplying the etchant through the supply pipe and discharging the etchant through the overflow pipe, the etchant in the etching tank can be prevented from being deteriorated by the work of grinding. Further, the discharge of the etchant through the drainpipe has the effect of enabling the interior of the etching tank to be cleaned easily and conveniently.

While there have been shown and described present preferred embodiments of the invention, it is to be distinctly understood that the invention is not limited thereto but may be otherwise embodied and practiced variously within the scope of the following claims.

What is claimed is:

1. A method for producing silicon wafers for use in semiconductor devices produced by cylindrically grinding a single crystal silicon ingot which has been kept in rotation on a pulling axis comprising the steps of:

slicing a cylindrically ground silicon ingot in a direction perpendicular or substantially perpendicular to said pulling axis thereby obtaining a wafer, chamfering said wafer, then grinding the main surface of said wafer in an etchant, and polishing the ground surface of said wafer for mirror finish, and which method is characterized by the fact that said etchant in which said grinding is carried out is continuously refreshed and contains no loose abrasive and permits selective etching of deformed layers existent in the surface part of said wafer, and wherein said etchant is selected from the group consisting of (1) a ternary reagent consisting of 5 to 35 wt % of hydrofluoric acid, 15 to 45 wt % of nitric acid, and 40 to 80 wt % of water and (2) a binary reagent consisting of 30 to 50 wt % of sodium hydroxide or potassium hydroxide and 70 to 50 wt % of water.

2. A method according to claim 1, further comprising the step of disposing a retaining member and a grinding member opposite each other in the vertical direction and inside an etching tank, and providing a vertical motion mechanism for removing said retaining member and said grinding member toward each other and away from each other.

3. An apparatus for producing silicon wafers for use in semiconductor devices where said wafers are produced by slicing wafers from a single crystal silicon ingot and grinding the main surface of said silicon wafer in the presence of an etchant containing no loose abrasive, which apparatus comprises:

an etching tank adapted to store an etchant, a retaining member adapted to fix a wafer, a grinding member furnished with a grindstone, wherein said retaining member and said grinding member are disposed opposite each other in the vertical direction and inside said etching tank, a vertical motion mechanism for moving said retaining member and said grinding member toward each other and away from each other, wherein said wafer is fixed to said retaining member, wherein both said grinding member and said retaining member are movable in a combination of motions selected from the group consisting of:

1) rotating said grinding member and said retaining member in mutually opposite directions;

2) rotating said grinding member while at the same time rotating and revolving said retaining member;

3) rotating said retaining member while at the same time rotating and revolving said grinding member, and 4) rotating said retaining member while at the same time said grinding member is reciprocated, and wherein said etching tank is provided with an etchant supply pipe, an overflow discharge pipe, and a drain-pipe.

4. An apparatus for producing silicon wafers for use in semiconductor devices by slicing a wafer from a single crystal silicon ingot and grinding the main surface of said silicon wafer in the presence of an etchant containing no loose abrasive, which apparatus comprises:

an etching tank filled with an etchant, a retaining member adapted to fix a wafer, a grinding member furnished with a grindstone, a surface to fix a wafer on said retaining member, and wherein the grindstone is set in place on said grinding member, wherein said retaining member and said grindstone are disposed opposite each other in a vertical direction, said retaining member having a rotation motion and a vertical reciprocating motion, said grinding member having a reciprocating motion within said etching tank, and wherein said etching tank is provided with an etchant supply pipe, an overflow discharge pipe, and a drain-pipe.

5. An apparatus for producing silicon wafers for use in semiconductor devices by slicing wafers from a single crystal silicon ingot and grinding the main surface of said silicon wafer in the presence of an etchant containing no loose abrasive, which apparatus comprises:

an etching tank having a grindstone on a bottom surface for grinding a wafer, being rotatable, and filled with an etchant, a retaining member adapted to fix a wafer, wherein the surface to fix a wafer on said retaining member is opposed to said grindstone in the vertical direction wherein said retaining member has a vertical reciprocating motion relative to said etching tank, wherein said retaining member has a motion selected from the group consisting of 1) rotation alone and 2) rotation in conjunction with a revolution, and wherein said etching tank is provided with an etchant supply pipe, an overflow discharge pipe, and a drain-pipe.

* * * * *